US008144106B2

(12) United States Patent
Kim

(10) Patent No.: US 8,144,106 B2
(45) Date of Patent: Mar. 27, 2012

(54) LIQUID CRYSTAL DISPLAY AND DRIVING METHOD THEREOF

(75) Inventor: Eun-sup Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1413 days.

(21) Appl. No.: 10/811,892

(22) Filed: Mar. 30, 2004

(65) Prior Publication Data

US 2004/0212580 A1 Oct. 28, 2004

(30) Foreign Application Priority Data

Apr. 24, 2003 (KR) ..... 2003-26012
Apr. 25, 2003 (KR) ..... 2003-26423

(51) Int. Cl.
*G09G 3/36* (2006.01)

(52) U.S. Cl. ..... 345/102; 345/87; 345/204; 345/212; 345/698; 349/61; 713/300

(58) Field of Classification Search ..... 345/102, 345/1.2, 211; 348/553; 315/291
See application file for complete search history.

(56) References Cited

U.S. PATENT DOCUMENTS 5,078,476 A * 1/1992 Shin ..... 345/102
5,574,336 A * 11/1996 Konopka et al. ..... 315/225
5,731,794 A * 3/1998 Miyazawa ..... 345/88
5,745,092 A * 4/1998 Ito ..... 345/95
5,854,617 A * 12/1998 Lee et al. ..... 345/102
6,020,879 A * 2/2000 Nakabayashi ..... 345/212
6,184,875 B1 * 2/2001 Matsuura ..... 345/211
6,211,918 B1 * 4/2001 Uwabata et al. ..... 348/458
6,275,267 B1 * 8/2001 Kobayashi ..... 348/555
6,327,000 B1 * 12/2001 Auld et al. ..... 348/441
6,348,910 B1 * 2/2002 Yamamoto et al. ..... 345/102

(Continued)

FOREIGN PATENT DOCUMENTS

JP 9-265074 10/1997

(Continued)

OTHER PUBLICATIONS

"Pulse Width Modulation Basics", G. Ledwich 1998. http://powerdesginers.com/infoweb/design_center/articles/pwm.pwm.shtm, pp. 1-4.*

(Continued)

*Primary Examiner* — Grant Sitta
(74) *Attorney, Agent, or Firm* — Staas & Halsey LLP

(57) ABSTRACT

A liquid crystal display (LCD) and a driving method thereof, which synchronize a panel with an inverter to prevent backlights from being turned off during a display mode change. The LCD includes a signal converter to convert selectively input analogue video signals into digital video signals according to a predetermined sampling clock, a scaler to sample the digital video signals output from the signal converter at a preset resolution according to a predetermined sampling clock and to extract a horizontal synchronization signal from the sampled digital video signals, an inverter to drive backlights in synchronization with the horizontal synchronization signal extracted by the scaler, a panel driver to receive the sampled digital video signals in a predetermined signal format and to display the received signals on a liquid crystal panel, and a controller to detect the horizontal synchronization signal from the input video signals to determine a display mode, to output sampling clock signals to the signal converter and the scaler according to the display mode, and to generate inverter on/off signals whenever the display mode is changed.

14 Claims, 3 Drawing Sheets

U.S. PATENT DOCUMENTS

| | | | | |
|---|---|---|---|---|
| 6,359,391 | B1 * | 3/2002 | Li | 315/291 |
| 6,404,145 | B1 * | 6/2002 | Saito | 315/307 |
| 6,535,217 | B1 * | 3/2003 | Chih et al. | 345/519 |
| 6,545,688 | B1 * | 4/2003 | Loveridge et al. | 345/660 |
| 6,577,348 | B1 * | 6/2003 | Park | 348/554 |
| 6,678,005 | B2 * | 1/2004 | Anderson et al. | 348/553 |
| 6,766,222 | B1 * | 7/2004 | Duley | 700/286 |
| 6,891,525 | B2 * | 5/2005 | Ogoro | 345/102 |
| 6,924,843 | B1 * | 8/2005 | Yamazaki et al. | 348/423.1 |
| 7,057,668 | B2 * | 6/2006 | Herrmann | 348/554 |
| 7,091,947 | B2 * | 8/2006 | Hsieh | 345/102 |
| 7,098,903 | B2 * | 8/2006 | Park et al. | 345/211 |
| 7,119,786 | B2 * | 10/2006 | Cui | 345/102 |
| 7,126,286 | B2 * | 10/2006 | Yoo et al. | 315/219 |
| 7,158,130 | B2 * | 1/2007 | Lee et al. | 345/211 |
| 7,180,514 | B2 * | 2/2007 | Kuno et al. | 345/211 |
| 7,330,170 | B2 * | 2/2008 | Hwang | 345/98 |
| 7,348,959 | B2 * | 3/2008 | Kim | 345/102 |
| 2001/0013854 | A1 * | 8/2001 | Ogoro | 345/102 |
| 2001/0022584 | A1 * | 9/2001 | Tsugawa | 345/211 |
| 2003/0038770 | A1 * | 2/2003 | Lee et al. | 345/102 |
| 2003/0151601 | A1 * | 8/2003 | Chung et al. | 345/211 |
| 2003/0214478 | A1 * | 11/2003 | Yoo et al. | 345/102 |
| 2004/0012551 | A1 * | 1/2004 | Ishii | 345/87 |
| 2004/0160435 | A1 * | 8/2004 | Cui et al. | 345/211 |

FOREIGN PATENT DOCUMENTS

| | | | |
|---|---|---|---|
| JP | 2002-141191 | | 5/2002 |
| KR | 1995-0033604 | | 12/1995 |
| KR | 2000-60041 | | 10/2000 |
| KR | 2001-0033591 | | 4/2001 |
| KR | 2001-55653 | * | 7/2001 |
| KR | 2001-0055653 | | 7/2001 |
| KR | 2002-0046661 | | 6/2002 |

OTHER PUBLICATIONS

Korean Office Action issued with respect to Korean Patent Application No. 10-2003-0026423, which corresponds to the above-referenced application.

* cited by examiner

LIQUID CRYSTAL DISPLAY AND DRIVING METHOD THEREOF

CROSS-REFERENCE TO RELATED APPLICATIONS

This application claims the priority of Korean Patent Application Nos. 2003-26012, filed on Apr. 24, 2003 and 2003-26423, filed on Apr. 25, 2003, in the Korean Intellectual Property Office, the disclosures of which are incorporated herein in their entirety by reference.

BACKGROUND OF THE INVENTION

1. Field of the Invention

The present invention relates to a liquid crystal display (LCD), and more particularly, to an LCD and a driving method thereof which synchronize a panel with an inverter to prevent backlights from being turned off during a mode change of the display.

2. Description of the Related Art

Liquid crystal displays (LCDs), which are being developed to replace cathode ray tubes (CRTs), have advantages of small size, light weight, and low power consumption, such that they are applicable to large information displays as well as laptop computers and desktop computers.

Since LCDs cannot emit light by themselves, they display information by reflecting extraneous light transmitted through an LCD panel, or by installing a separate light source, that is, a backlight assembly on a rear surface of the LCD panel.

A backlight assembly includes a lamp to radiate light, a light guide panel to guide the light radiated by the lamp toward the LCD panel, and optical sheets to diffuse and condense the light guided by the light guide panel to improve luminous efficiency.

A lamp includes lamps acting as a light source for the LCD, reflectors to reflect light radiated by the lamps to improve luminous efficiency, and an inverter connected to the lamp by a wire to apply voltage to the lamps.

For large LCDs, backlights are installed directly below the LCD. In this case, however, the distance between the lamp and the LCD panel is so close that interference occurs between the oscillating frequency of the lamp and the scanning frequency of the LCD panel. Therefore, noise is generated on a screen as a result of the interference between the oscillating frequency of the lamp and the scanning frequency of the LCD panel.

Furthermore, LCDs display signals which are generated in televisions, DTVs, computers, etc. according to a user's selection. Since the signals generated in televisions, DTVs, computers, and so on have different frequencies and formats, a display mode should be changed according to the user's selection. Accordingly, whenever the display mode needs to be changed, a scaler should adjust the level of input signals. Whenever a display mode is changed, horizontal synchronization signals contained in video signals suffer a transient effect. As a consequence, the horizontal synchronization signals directly affect the ability of the panel to function properly.

SUMMARY OF THE INVENTION

An aspect of the present invention provides a liquid crystal display (LCD) and a driving method thereof, which synchronizes the scanning frequency of an LCD panel with an inverter to remove noise on a screen, and controls the operation of the inverter during a mode change of the display to prevent backlights from being turned off.

According to another aspect of the present invention, there is provided an LCD comprising: a signal converter to convert selectively input analogue video signals into digital video signals in synchronization with a predetermined sampling clock signal; a scaler to sample the digital video signals output from the signal converter at a preset resolution in synchronization with a predetermined sampling clock signal and to extract a horizontal synchronization signal from the sampled digital video signals; an inverter to drive backlights in synchronization with the horizontal synchronization signal; a panel driver to receive the sampled digital video signals in a predetermined signal format and displays the received signals on a liquid crystal panel; and a controller to detect the horizontal synchronization signal from the input video signals to determine a display mode, to output sampling clock signals to the signal converter and the scaler according to the determined display mode, and to generate inverter on/off signals whenever the display mode is changed.

According to yet another aspect of the present invention, there is provided a method of controlling an inverter to drive backlights in an LCD, the method comprising: determining whether a display mode changes while video signals are displayed; and applying backlight off signals to the inverter while the display mode is changing, and applying backlight on signals to the inverter when a horizontal synchronization signal is detected.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
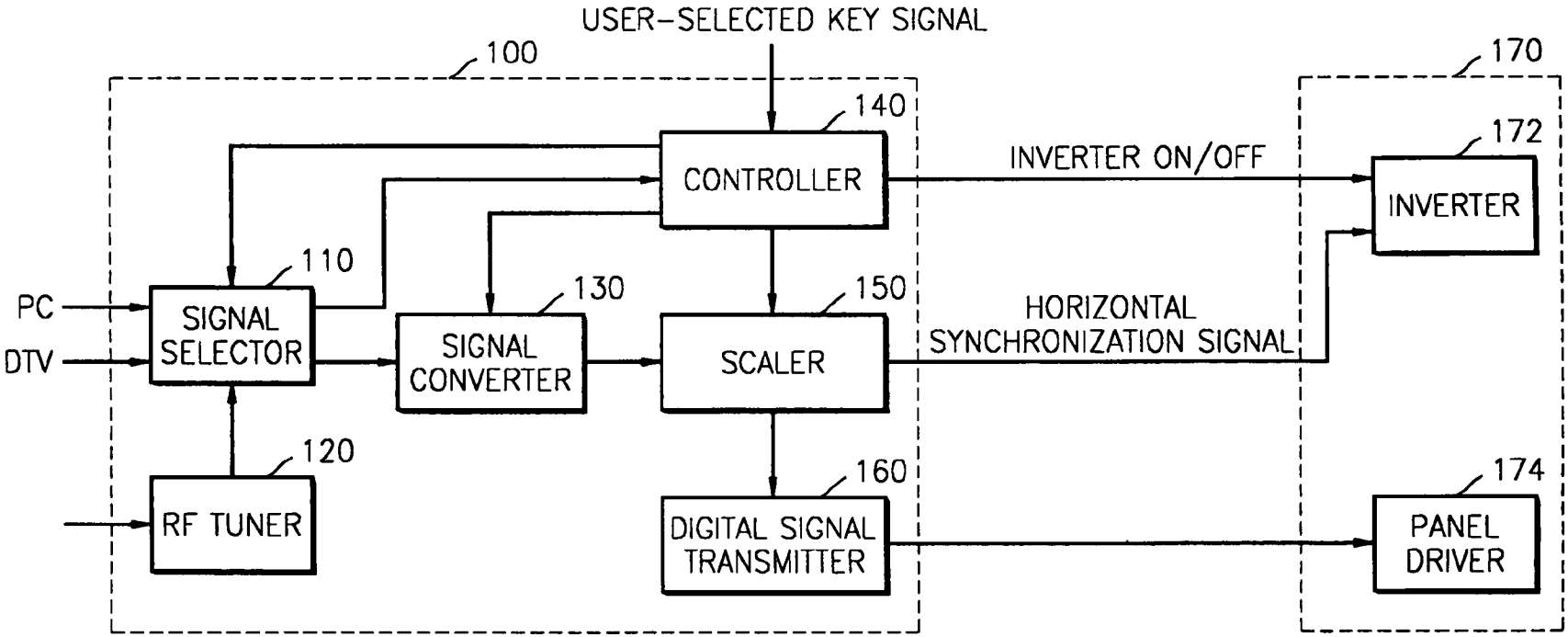
FIG. 1 is a block diagram of the overall configuration of a liquid crystal display (LCD) according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a block diagram of the overall configuration of a liquid crystal display (LCD) according to an embodiment of the present invention.

The LCD includes a video signal processing board 100, which processes video signals, and a panel 170, which drives backlights according to a horizontal synchronization signal processed by the video signal processing board 100 and displays the video signals.

A signal selector 110 selects wanted signals, such as red, green and blue (RGB) video signals, radio frequency (RF)

signals, or composite video base signals (CVBSs) generated in a personal computer (PC), a desktop video (DTV), or an RF tuner, according to selection signals of a controller 140.

A signal converter 130 samples the selected signals from the RGB video signals, RF signals, and CVBS signals according to a sampling clock supplied by the controller 140. The signal converter 130 then converts the selected signals into digital video signals.

A scaler 150 up and down samples the digital video signals input from the signal converter 130 to discern signals, which are suitable for the resolution of a panel according to a sampling clock generated by the controller 140. The scaler 150 further extracts horizontal synchronization signal from the video signals.

The controller 140 receives user-selected key signals and outputs selection signals to the signal selector 110, determines a display mode by detecting horizontal and vertical synchronization signals from the video signals selected by the signal selector 110, and outputs sampling clock signals to the signal converter 130 and the scaler 150. The converter 130 and the scaler 150 use the sampling clocks to perform signal processing according to the display mode. Here, whenever the display mode is changed, the horizontal synchronization signal contained in the video signals suffer a transient effect. Furthermore, when an inverter 172 is driven in synchronization with the horizontal synchronization signal, the transient horizontal synchronization signal directly affects the inverter 172. When the inverter 172 inputs a signal with an oscillating frequency in synchronization with the transient horizontal synchronization signal, a transient voltage occurs. As a result, the inverter 172 causes backlight lamps 230 to be turned off due to the transient horizontal synchronization signal. Accordingly, the controller 140 generates inverter on/off signals to turn the inverter on or off whenever the display mode is changed.

A digital signal transmitter 160 transmits the digital video signals output from the scaler 150 in a low voltage differential signal (LVDS) format.

The inverter 172 generates pulse width modulation (PWM) signals in synchronization with the horizontal synchronization signal extracted by the scaler 150, and is turned on or off according to the inverter on/off signals input from the controller 140.

A panel driver 174 displays the digital signals received in the LVDS format from the digital signal transmitter 160 on a liquid crystal panel. That is to say, the panel driver 174 inputs scaled video data or gain-adjusted video data to switch the liquid crystal panel on or off. Alternately, the panel driver 174 generates drive signals according to a resolution of the video data.

As a consequence, enable signals for the inverter 172 and the panel driver 174 are synchronized with the horizontal synchronization signal extracted by the scaler 150, so as to remove oscillatory interference between the inverter 172 and the panel driver.

Figure 2:
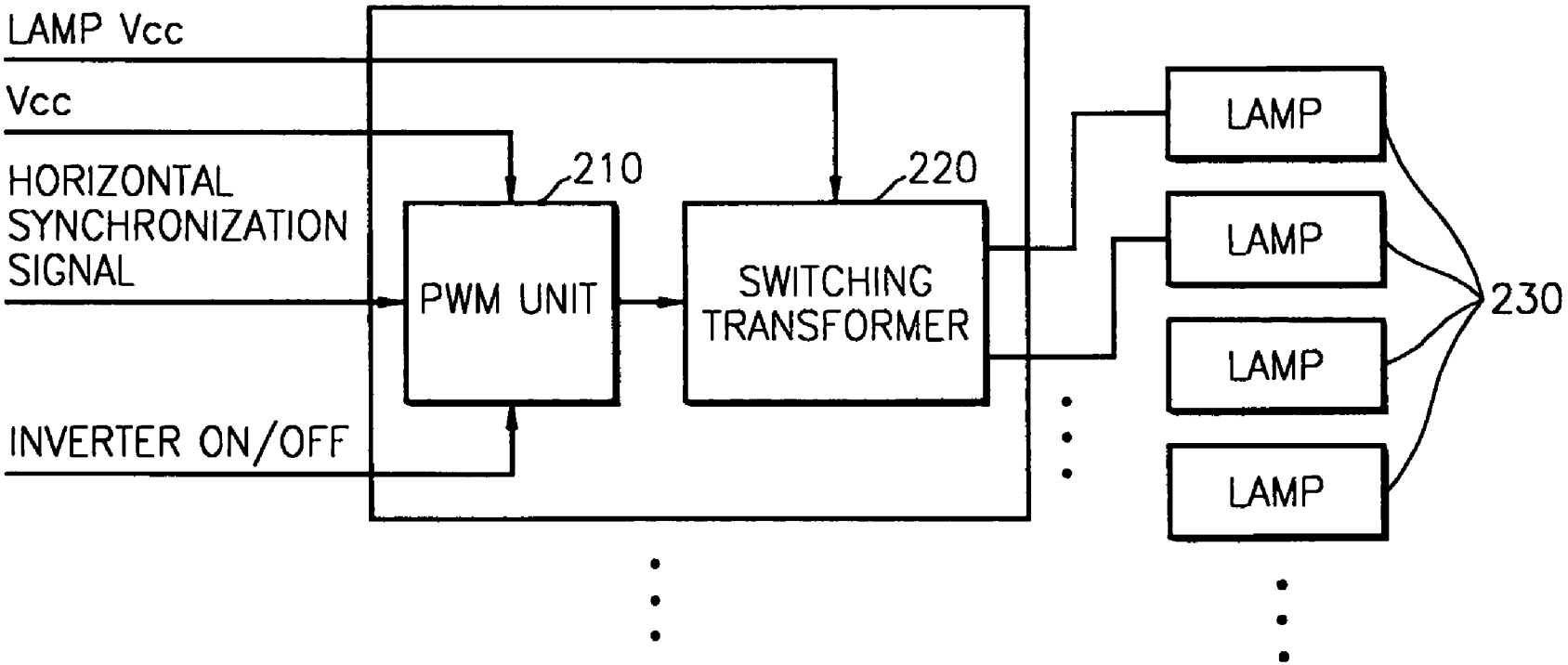
FIG. 2 is a detailed block diagram of an inverter shown in FIG. 1.

FIG. 2 is a detailed block diagram of the inverter 172 shown in FIG. 1.

Referring to FIG. 2, a PWM 210 generates PWM signals in synchronization with the horizontal synchronization signal generated by the scaler 150 of the video signal processing board 100, and is turned on or off according to the inverter on/off signals generated by the controller 140 of the video signal processing board 100. For example, falling edges or rising edges of the horizontal synchronization signal are synchronized with falling edges or rising edges of the PWM signals. The PWM 210 includes switch enable/disable terminals and power enable/disable terminals inside thereof. Thus, when the display mode change begins, the controller 140 disables the PWM signals using the inverter off signals, and when the display mode change ends, the controller 140 enables the PWM signals using the inverter on signals.

A switching transformer 220 is driven by a lamp voltage source lamp Vcc, and generates DC switching power according to the PWM signals input from the PWM 210.

The backlight lamps 230 radiate light using the DC switching power supplied by the switching transformer 220.

Figure 3:
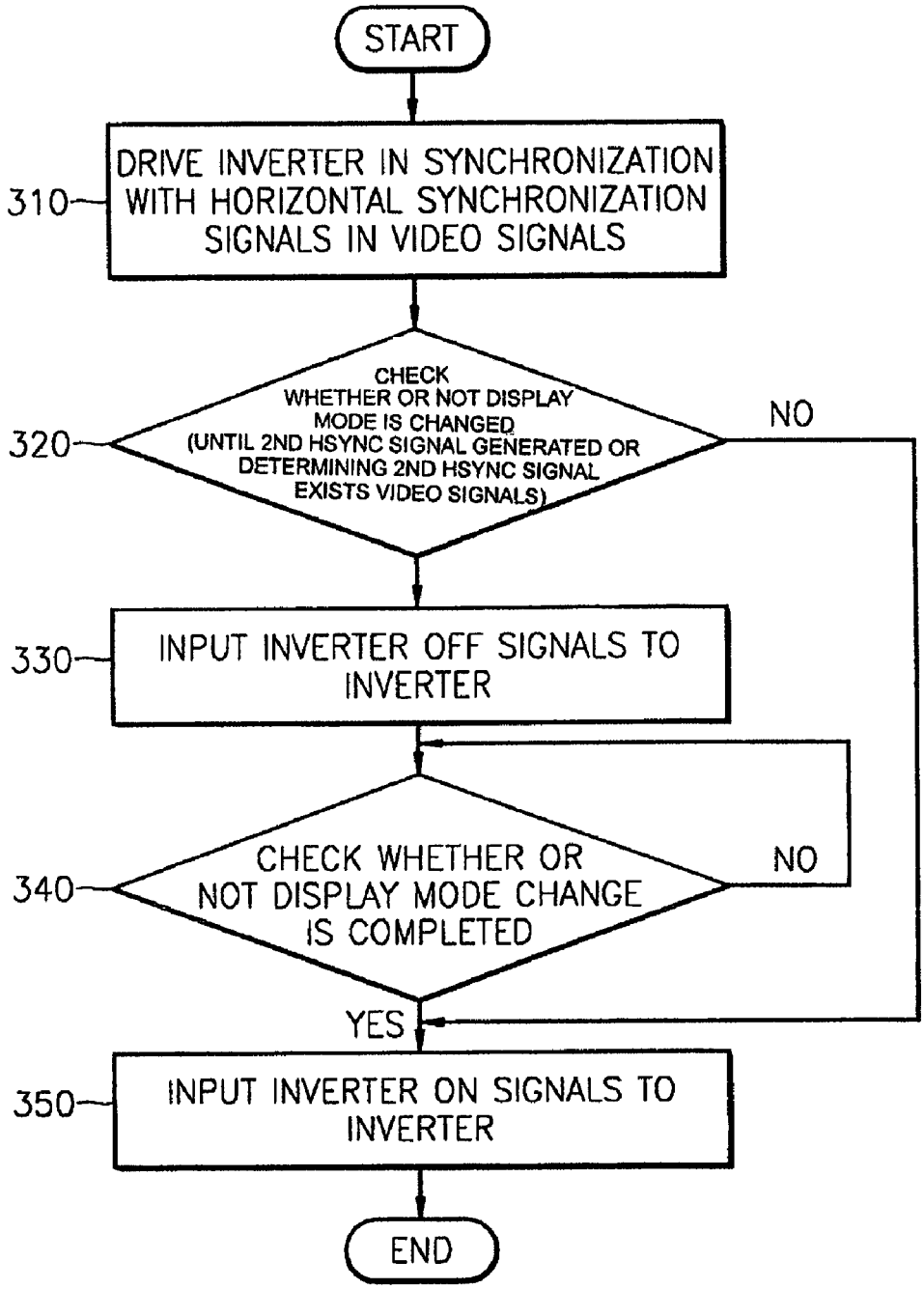
FIG. 3 is a flow chart illustrating a method in which a controller 140 controls backlights to be driven according to the present invention.

FIG. 3 is a flow chart illustrating a method in which the controller 140 controls backlights to be driven according to the present invention.

First, in operation 310, when video signals are input, the inverter is driven in synchronization with the horizontal synchronization signal in the digital video signals.

Next, in operation 320, the controller determines whether the user has changed the display mode. As an example, if the video signals of a PC are displayed when the user inputs key signals to change the video signals to DTV signals, the controller 140 recognizes the key signals as display mode change signals. If the display mode is changed, the controller continues to operation 330, otherwise the controller jumps to operation 350. Operation 320 may also include checking until the second horizontal synchronization signal is generated.

In operation 330, the controller inputs the inverter off signals to the inverter. For example, if the user changes the display mode from that of a PC to that of a DTV, a mode change duration from the beginning of the display mode change to the end of the display mode change is defined as the duration where transient horizontal synchronization signal is generated.

Next, in operation 340, the controller determines whether a horizontal synchronization signal exist in the video signal to determine whether the display mode change is completed. If the display mode change is completed, the controller continues to operation 350, otherwise the controller repeats operation 340.

In operation 350, the controller inputs the inverter on signals to the inverter.

Thus, the inverter is turned off during the display mode change, and turned on thereafter, but the inverter is prevented from being turned off due to a transient horizontal synchronization signal.

As described above, the panel and the inverter in the LCD are synchronized with one another to avoid oscillatory interference therebetween and remove noise on a screen, and the inverter is turned off during the display mode change to prevent the backlights from being turned off.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A liquid crystal display, having a liquid crystal panel and backlights, comprising:

a signal converter to convert selectively input analogue video signals into digital video signals in synchronization with a first predetermined sampling clock signal;

a scaler to sample the digital video signals at a panel resolution in synchronization with a second predetermined sampling clock signal, and to extract a horizontal synchronization signal from the sampled digital video signals;

a panel driver to display the digital video signals on the liquid crystal panel;

a controller to detect the extracted horizontal synchronization signal from the digital video signals to determine a display mode, to output the first and second predetermined sampling clock signals to the signal converter and the scaler, respectively, according to the determined display mode, and to generate inverter on and off signals whenever the horizontal synchronization signal is transiently changed; and a backlight driver to drive the backlights in synchronization with the detected horizontal synchronization signal, the backlight driver including a pulse width modulator to generate pulse width modulation signals, which are synchronized with the horizontal synchronization signal, and to turn the pulse width modulation signals on or off according to the on and off signals generated by the controller, and a switching transformer to switch a power supply on or off according to the pulse width modulation signals, wherein enable signals for the pulse width modulator and the panel driver are synchronized with the horizontal synchronization signal extracted by the scaler, wherein the backlights comprise a radiator lamp which radiates light using the power supplied by the switching transformer, wherein when the pulse width modulation signals are turned off, the switching transformer switches a power on to the radiator lamp, whereby the radiator lamp is prevented from being disabled as a result of the display mode change.

2. The liquid crystal display of claim 1, wherein the controller generates and outputs the off signals to the backlight driver when the horizontal synchronization signal is changed.

3. A method in which a controller controls backlights in a liquid crystal display, comprising:

controlling a backlight driver to drive the backlights in synchronization with a first horizontal synchronization signal in a digital video signal when video signals are input;

determining whether a user has changed a display mode;

inputting an off signal to the backlight driver, if the first horizontal synchronization signal is transiently changed, to control the backlight driver to not drive the backlights;

checking whether the first horizontal synchronization signal change is completed;

inputting an backlight driver on signal to the backlight driver if the first horizontal synchronization signal change is completed so as to control the backlight driver to drive the backlights in synchronization with a second horizontal synchronization signal;

generating the backlight driver off signal until the second horizontal synchronization signal is detected; and turning the backlight driver on or off according to the backlight driver on and off signals, wherein the backlight driver includes a pulse width modulator to generate pulse width modulation signals, which are synchronized with the first and second horizontal synchronization signals, and to turn the pulse width modulation signals on or off according to the on and off signals generated by the controller, and a switching transformer to switch a power supply on or off according to the pulse width modulation signals, enable signals for the pulse width modulator being synchronized with the first horizontal synchronization signal, the backlights use the power supplied by the switching transformer, and when the backlight driver is turned off during a display mode change when the pulse width modulation signals are turned off, the switching transformer switches a power on to the radiator lamp, whereby the backlights are prevented from being disabled as a result of the display mode change.

4. The method according to claim 3, further comprising repeating the checking if the first horizontal synchronization signal change is not completed.

5. The method according to claim 3, further comprising initially skipping the determining, the inputting the backlight driver off signal, and the checking operations if the user has not changed the first horizontal synchronization signal.

6. The method according to claim 3, wherein the determining comprises recognizing key signals as first horizontal synchronization signal change signals if the video signals are those of a PC and are displayed when the user inputs the key signals to change the video signals.

7. The method according to claim 3, wherein the determining comprises determining whether a display mode is changed from a PC to that of a DTV.

8. The method according to claim 3, wherein the checking lasts until the second horizontal synchronization signal is generated.

9. The method according to claim 3, wherein the checking comprises determining whether the second horizontal synchronization signal exists in the video signals.

10. A liquid crystal display, having a liquid crystal panel and backlights, comprising:

a signal converter to convert a video signal into a digital video signal in synchronization with a first sampling clock signal;

a scaler to sample the digital video signal at a panel resolution in synchronization with a second sampling clock signal, and to extract a first synchronization signal therefrom;

a panel driver to display the digital video signals on the liquid crystal panel;

a controller to detect the synchronization signal from the digital video signal to determine a display mode, to output the first and second sampling clock signals to the signal converter and the scaler, respectively, according to the determined display mode, and to generate on and off signals whenever the synchronization signal is transiently changed; and a backlight driver to drive the backlights in synchronization with a second synchronization signal and being turned on or off according to the on/off signals input from the controller, the backlight driver including a pulse width modulator to generate pulse width modulation signals, which are synchronized with the horizontal synchronization signals, and to turn the pulse width modulation signals on or off according to the on and off signals generated by the controller, and a switching transformer to switch a power supply on or off according to the pulse width modulation signals, wherein enable signals for the pulse width modulator and the panel driver are synchronized with the first horizontal synchronization signal extracted by the scaler, wherein the controller generates the off signals until the second synchronization signal is detected, and wherein when the pulse width modulation signals are turned off, the switching transformer switches a power on to the backlights, whereby the backlights are prevented from being disabled as a result of the display mode change.

11. The liquid crystal display according to claim 10, wherein the controller determines a display mode.

12. The liquid crystal display according to claim 11, wherein the controller outputs the first and second sampling clock signals to the signal converter and the scaler, respectively, according to the determined display mode.

13. The liquid crystal display according to claim 10, wherein the backlights comprise a lamp to radiate light using the power supplied by the switching transformer.

14. The liquid crystal display according to claim 10, wherein the controller generates and outputs off signals to the backlight driver when the display mode is changed, and continues generating and outputting off signals until the second synchronization signal is detected.

* * * * *

UNITED STATES PATENT AND TRADEMARK OFFICE

CERTIFICATE OF CORRECTION

PATENT NO. : 8,144,106 B2
APPLICATION NO. : 10/811892
DATED : March 27, 2012
INVENTOR(S) : Eun-sup Kim It is certified that error appears in the above-identified patent and that said Letters Patent is hereby corrected as shown below:

On the Title pg., Item (56) (Other Publications), Line 2, Delete "powerdesginers.com" and insert -- powerdesigners.com --, therefor.

Signed and Sealed this
Tenth Day of July, 2012

David J. Kappos

David J. Kappos
*Director of the United States Patent and Trademark Office*